US006420693B1

(12) United States Patent
Nakatsuji et al.

(10) Patent No.: US 6,420,693 B1
(45) Date of Patent: Jul. 16, 2002

(54) FOREIGN OBJECT INSERTION DETECTOR DEVICE

(75) Inventors: Naohiro Nakatsuji; Masahiro Kume; Morihiko Toyozumi; Yasuyo Matsumoto; Mitsutoshi Kamakura, all of Nagoya (JP)

(73) Assignees: Autonetworks Technologies, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/391,230

(22) Filed: Sep. 7, 1999

(30) Foreign Application Priority Data

Feb. 5, 1999 (JP) ..... 11-028785

(51) Int. Cl.[7] ..... G06M 7/00
(52) U.S. Cl. ..... 250/221; 250/227.14; 49/25
(58) Field of Search ..... 250/221, 227.14, 250/227.16; 49/25–28; 318/480; 180/271

(56) References Cited

U.S. PATENT DOCUMENTS 5,399,851 A * 3/1995 Strand ..... 250/222.1
5,780,985 A * 7/1998 Bickley et al. ..... 318/460
5,912,625 A * 6/1999 Scofield ..... 340/665

FOREIGN PATENT DOCUMENTS

JP A-58-26621 2/1983

* cited by examiner

*Primary Examiner*—Que T. Le
*Assistant Examiner*—Thanh X. Luu
(74) *Attorney, Agent, or Firm*—Oliff & Berridge, PLC

(57) ABSTRACT

In the foreign object insertion detector device, the light (infrared rays) is transmitted into the internal space 13 of a tube body 11 implanted into a weather strip 9 and formed of elastic material and, if there occurs the insertion of a foreign object, then the foreign object produces a pressing force and applies the pressing force to the tube body 11 to thereby deform the tube body 11. If the tube body 11 is deformed in this manner, then the quantity of the light transmitted through the internal space 13 is caused to decrease. By judging whether a decrease in the quantity of the light transmitted through the internal space 13 is present or absent, the insertion of the foreign object can be detected. In order to able to detect the pressing force given from obliquely downward directions C and D by the foreign object with high sensitivity, in the obliquely downward car exterior side or obliquely downward car exterior side of the tube body 11 in the weather strip 9, as pressing means 12, there are formed cavity portions 31, 33 as well as projecting portions 37, 39. Thanks to this structure, the pressing force from the foreign object can be applied through the projecting portions 37 and 39 to the tube body 11 collectively without being dispersed.

11 Claims, 9 Drawing Sheets

FOREIGN OBJECT INSERTION DETECTOR DEVICE

BACKGROUND OF THE INVENTION

1. Field of the Invention

The present invention relates to a foreign object insertion detector device which is applied to a car power window device.

2. Description of the Related Prior Art

Conventionally, as a foreign object insertion detector device to be applied to a car power window device, there are known the following foreign object insertion detector devices.

That is, as a first conventional foreign object insertion detector device, there is known a foreign object insertion detector device which detects the insertion of a foreign object according to whether there is present an excess current or not which flows in a motor used to drive, that is, open and close the windowpane of a car window.

Also, as a second conventional foreign object insertion detector device, there is known a foreign object insertion detector device in which a soft tube body filled with transparent liquid of a high refractive index and formed of elastic material having a lower refractive index than that of the transparent liquid is implanted into a weather strip and, on both sides of the soft tube body in the longitudinal direction thereof, there are disposed a light emitting element and a light receiving element (Japanese Patent Publication No. 58-26621 of Showa). In the present insertion detector device, the light emitted from the light emitting element disposed on one end side is allowed to enter the transparent liquid serving as a core so that, while the light is being reflected totally by the inner peripheral surface of the soft tube body, the light is transmitted to the other end side and is received by the light receiving element; and, based on variations in the quantity of the light received by the light receiving element, the insertion of a foreign object can be detected.

In other words, in this conventional detector device, if there occurs any foreign object insertion and the soft tube body is elastically deformed due to a pressing force given from the foreign object, then the angle of incidence of the light entering the inner peripheral surface of the elastically deformed portion of the soft tube body varies; and, due to this, most of the light transmitted through the transparent liquid is changed in the advancing direction thereof and thus the light is caused to enter the inner peripheral surface of the soft tube body at the angle of incidence lower than or equal to a critical angle where the total reflection of the light occurs, with the result that the light is caused to leak outside the transparent liquid which serves as a guide path for the light. That is, the present detector device detects a decrease in the quantity of the received light of the light receiving element caused by the above-mentioned leakage of the light to thereby be able to detect the insertion of the foreign object.

However, in the above-mentioned first conventional foreign object insertion detector device, in order to prevent the foreign object insertion detector device from malfunctioning due to an excess current flowing in the motor when closing the windowpane tightly, the foreign object insertion preventive function of the detector device must be removed shortly before the windowpane is closed completely, with the result that the insertion preventive condition up to the time when the windowpane is closed completely cannot be secured positively.

Also, since the first conventional foreign object insertion detector device detects the insertion of a foreign object by detecting an excess current which is caused to flow when a load of a reference value or larger is applied to the motor, if the reference value is set too low, then there is a possibility that the presence of a foreign object insertion can be detected in error although no foreign object insertion exists actually. In order to prevent such erroneous detection, the reference value cannot be set excessively low. However, if the reference value is set rather high, then the detecting sensitivity is lowered accordingly. Therefore, when an operator's hand or the like is caught between the car window and the windowpane, a great force can be applied to the hand.

On the other hand, in the above-mentioned second conventional foreign object insertion detector device, since the transparent liquid must be enclosed into the soft tube body, the structure of the soft tube body is made complicated, which results in the expensive manufacturing cost of the soft tube body.

Also, in order to be able to detect the insertion of a foreign object before a great force from the motor is given to the foreign object, preferably, the soft tube body may be elastically deformed easily by a relatively small pressing force. However, in the second conventional foreign object insertion detector device, since the transparent liquid must be enclosed with a certain level of constant pressure, if the hardness of the soft tube body is set too low, then there is a possibility that the soft tube body can be caused to swell more than necessary or the soft tube body can be deformed due to the weight of the transparent liquid too much to keep its shape. Therefore, the soft tube body must be so set as to have hardness equal to or higher than a given level of hardness, which unfavorably results in the poor detecting sensitivity of the pressing force from the foreign object.

Further, since the soft tube body is structured such that it encloses the transparent liquid therein, there is no space for the internal pressure thereof to escape and thus, when the pressing force from the foreign object is applied to the soft tube body, the internal pressure of the soft tube body increases in proportion to an increase in the pressing force applied from the foreign object; that is, as the pressing force from the foreign object increases, the repulsive force of the soft tube body against the pressing force from the foreign object increases. Therefore, the soft tube body with the transparent liquid enclosed therein is difficult to deform when an external pressing force is applied thereto, which also provides a factor in lowering the detecting sensitivity of the pressing force from the foreign object.

Still further, there is also found a problem that it is difficult to keep the reliability of the sealed enclosure of the transparent liquid for a long period of time.

Yet further, when water is used as the transparent liquid, the water can be frozen depending on the using temperatures thereof, which causes the light to be scattered within the light guide path, with the result that the foreign object detector device using the water can fail to function.

In addition, normally, the elastic material that is used to form the soft tube body has a low degree of crystallinity in the using temperatures (−40° C.–+100° C). Therefore, the elastic material is easy to swell by the liquid that is enclosed in the soft tube body, or some of the elastic material is easy to deteriorate in quality.

SUMMARY OF THE INVENTION

The present invention aims at eliminating the drawbacks found in the above-mentioned conventional foreign object insertion detector devices. Accordingly, it is an object of the invention to provide a foreign object insertion detector device which is simple in structure, can be reduced in the manufacturing cost thereof, is highly reliable, is able to detect a pressing force from a foreign object with high sensitivity, and is also able to detect even the insertion of the foreign object occurring just before the windowpane is closed completely.

As technical means for attaining the above object, according to the invention, there is provided, for use in a car power window device in which a car window can be opened and closed as a windowpane is driven or opened and closed by a drive mechanism under the control of a given control part, a foreign object insertion detector device for detecting the insertion of a foreign object between the car window and the windowpane when the car window is closed by the windowpane, the foreign object insertion detector device comprising: a weather strip disposed in the car window and including, in the inner peripheral portion thereof opposed to the closing-direction downstream side end portion of the windowpane, a light transmitting cavity portion extending along the longitudinal direction of the inner peripheral portion and communicating with the outside; pressing means disposed at least on one of the obliquely downward car exterior side and obliquely downward car interior side of the light transmitting cavity portion in the weather strip and, on receiving a pressing force given thereto from an obliquely downward direction with respect to the opening and closing direction of the windowpane, for deforming the light transmitting cavity portion in such a manner that it is crushed;

light emitting means for emitting a given light into the light transmitting cavity portion from one side of the longitudinal direction of the light transmitting cavity portion; light receiving means for receiving the light emitted by the light emitting means, reflected by the inner peripheral surface of the light transmitting cavity portion and transmitted to the other side of the longitudinal direction of the light transmitting cavity portion; and, judging means for monitoring one by one the quantities of the light received by the light receiving means, and also, on detecting a decrease in the quantity of the received light of the light receiving means caused when the weather strip is elastically deformed by a pressing force from said foreign object and the light transmitting cavity portion is thereby deformed in a crushing manner, for judging the presence of the insertion of the foreign object.

Preferably, the pressing means may comprise: a first cavity portion formed on the obliquely downward car exterior side of the light transmitting cavity portion in the weather strip in such a manner that it extends along the longitudinal direction of the light transmitting cavity portion; and, a first projecting portion which is provided on the obliquely downward car exterior side inner peripheral surface of the first cavity portion in such a manner that it extends along the longitudinal direction of the first cavity portion, and also which is capable of deforming the light transmitting cavity portion.

Also, preferably, the pressing means may comprise: a second cavity portion formed on the obliquely downward car interior side of the light transmitting cavity portion in the weather strip in such a manner that it extends along the longitudinal direction of the light transmitting cavity portion; and, a second projecting portion which is provided on the obliquely downward car interior side inner peripheral surface of the first cavity portion in such a manner that it extends along the longitudinal direction of the second cavity portion, and also which is capable of deforming the light transmitting cavity portion.

Further, preferably, the pressing means may comprise: third and fourth cavity portions respectively formed on the obliquely downward car exterior side of the light transmitting cavity portion in the weather strip in such a manner that they extend along the longitudinal direction of the light transmitting cavity portion at a given distance substantially in the vertical direction; and, a portion of the weather strip situated between the third and fourth cavity portions and acting as a pressing portion for deforming the light transmitting cavity portion.

Still further, preferably, the pressing means may comprise: fifth and sixth cavity portions respectively formed on the obliquely downward car interior side of the light transmitting cavity portion in the weather strip in such a manner that they extend along the longitudinal direction of the light transmitting cavity portion at a given distance substantially in the vertical direction; and, a portion of the weather strip situated between the fifth and sixth cavity portions and acting as a pressing portion for deforming the light transmitting cavity portion.

Yet further, preferably, the pressing means may comprise: a corner portion of the weather strip provided on and projected from the light transmitting cavity portion toward at least one of the obliquely downward car exterior side and obliquely downward car interior side.

And, preferably, the inner peripheral surface of the light transmitting cavity portion may be coated with a given light reflecting member for reflecting said light.

Also, preferably, the light transmitting cavity portion may be formed by implanting a hollow tube body formed of a given elastic material into the weather strip.

Further, preferably, the light transmitting cavity portion may be formed by forming a cavity in the weather strip itself.

As another technical means for attaining the above object, according to the invention, there is provided, for use in a car power window device in which a car window can be opened and closed as a windowpane is driven or opened and closed by a drive mechanism under the control of a given control part, a foreign object insertion detector device for detecting the insertion of a foreign object between the car window and the windowpane when the car window is closed by the windowpane, the foreign object insertion detector device comprising: a hollow tube body formed of light transmissive elastic material and implanted in a portion of the inner peripheral portion of a weather strip disposed in the car window, which is situated opposed to the closing-direction downstream side end portion of the windowpane, in such a manner that it extends along the longitudinal direction of the weather strip inner peripheral portion, with an internal space of the tube body being structured such that it communicate with the outside; pressing means disposed at least on one of the obliquely downward car exterior side and obliquely downward car interior side of the tube body in the weather strip and, on receiving a pressing force given thereto from an obliquely downward direction with respect to the opening and closing direction of the windowpane, for deforming the tube body in such a manner that it is crushed; light emitting means for emitting a given light into at least one of the internal space and the tube body from one side of the longitudinal direction of the tube body; light receiving means for receiving the light emitted by the light emitting means, transmitted through at least one of the internal space and the tube body, and transmitted to the other side of the longitudinal direction of the tube body; judging means for monitoring one by one the quantities of the light received by the light receiving means, and also, on detecting a decrease in the quantity of the received light of the light receiving means caused when the weather strip is elastically deformed by a pressing force from the foreign object and the tube body is thereby deformed in a crushing manner, for judging the presence of the insertion of the foreign object.

Also, preferably, the light emitting means may emit the light into the tube body from the above-mentioned one side of the longitudinal direction of the tube body, and the light receiving means may receive the light emitted by the light emitting means, transmitted through the tube body, and transmitted to the other side of the longitudinal direction of the tube body.

The present disclosure relates to the subject matter contained in Japanese patent application No. Hei. 11-028785 (filed on Feb. 5, 1999) which is expressly incorporated herein by reference in its entirely.

DETAILED DESCRIPTION OF THE PREFERRED EMBODIMENTS

1. First Embodiment

Figure 1:
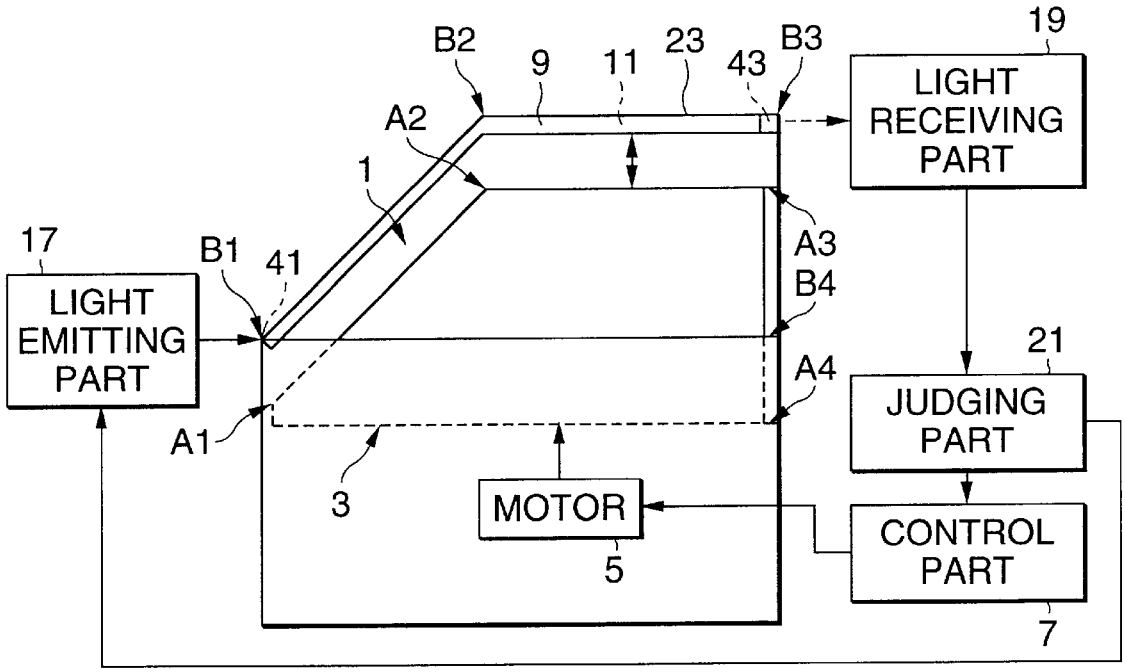
FIG. 1 is a block diagram of a car power window device to which a foreign object insertion detector device according to a first embodiment of the invention is applied.
Figure 2:
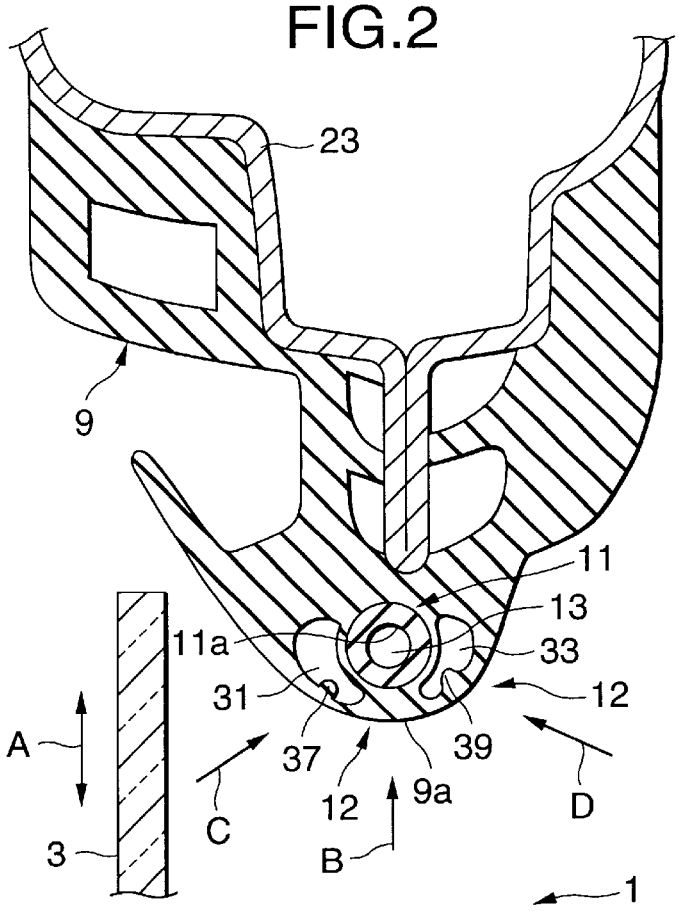
FIG. 2 is a section view of a weather strip in which a tube body to be provided in the power window device shown in FIG. 1 is disposed.
Figure 3:
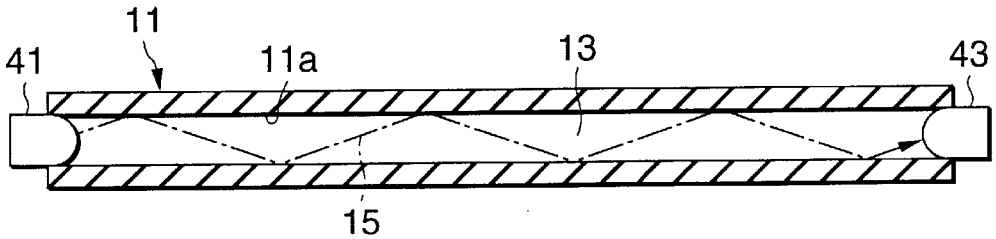
FIG. 3 is a schematic section view of the whole shape of the tube body shown in FIG. 2.

Now, FIG. 1 is a block diagram of a car power window device which incorporates therein a foreign object insertion detector device according to a first embodiment of the invention, FIG. 2 is a section view of a weather strip in which a tube body employed in the power window device shown in FIG. 1 is disposed, and FIG. 3 is a schematic section view of the whole shape of the tube body shown in FIG. 2.

The present power window device, generally, comprises a windowpane 3, an opening and closing mechanism including a motor 5 for driving or opening and closing the windowpane 3 in the vertical direction, a control part (control means) 7 for driving or controlling the motor 5 of the present opening and closing mechanism, a tube body 11 which is implanted into the inner peripheral portion 9*a* of a weather strip 9, pressing means 12 (see FIG. 2) disposed on the two outer and inner sides of the inner peripheral portion 9*a* of the weather strip 9, a light emitting part (light emitting means) 17 and a light receiving part (light receiving means) 19 respectively for emitting and receiving the light (here, an infrared ray having a wavelength of, for example, 950 nm) through the internal space (a cavity portion for light transmission) 13 of the tube body 11, and judging part (judging means) 21 for judging the presence or absence of the insertion of the foreign object through the light emitting part 17 and light receiving part 19. The present power window device is structured such that it is able to detect the foreign object insertion by detecting a decrease in the quantity of the light received by the light receiving part 19 caused when the tube body 11 is elastically deformed in a crushing manner through the weather strip 9 due to the insertion of the foreign object.

The tube body 11, as shown in FIGS. 2 and 3, is a cylindrical-shaped hollow elastic member having an internal space 13 which communicates through the elastic member to the outside in the longitudinal direction thereof; and, the tube body 11 is formed of a flexible elastic material which not only can be deformed flexibly with respect to an external force applied thereto but also, if the external force is removed, can be restored. The internal space 13 of the tube body 11 is in communication with the outside of the tube body 11 and is filled with gas (here, air) having a refractive index lower than that of the elastic material forming the tube body 11. Also, preferably, the internal surface 11*a* of the tube body 11 may be finished in a surface as smooth as possible so that it can reflect the light 15 with high efficiency.

Because it is necessary that the tube body 11 should be deformed easily by an external force, the elastic material for forming the tube body 11, preferably, may have the Shore D hardness of 50 or less. Also, even if the tube body 11 is deformed due to shocks (for example, a pressing force of 100N) given thereto when the insertion of a foreign object occurs or in an accident, it is necessary that the elastic material can restore its original shape. Further, even if the tube body 11 is deformed repeatedly, it is necessary that the elastic material can keep flexibility and is excellent in durability. As the elastic material that can meet these requirements, for example, there are available silicone rubber, butadiene rubber, polyacrylate rubber, acrylonitrile rubber, butyl rubber, vinyl chloride, ethylene copolymer (ethylene-propylene system copolymer, ethylene-acrylic acid copolymer, ethylene-ethylacrilate copolymer, ethylene-vinyl acetate copolymer, ethylene-αolefin copolymer, and the like), styrene system copolymer such as styrene-butadiene copolymer, polyamide system elastomer, polyurethane system elastomer, polyester system elastomer, fluorine system elastomer such as vinylidienefluoride-tetraflouoroethylene-hexafluoropropylene: that is, anyone of them can be used singly, or two or more kinds of them can be mixed together before they are used. Here, the tube body 11 is formed of silicone rubber.

The thus structured tube body 11, as shown in FIGS. 1 and 2, is implanted in such inside portion of the weather strip 9 that is disposed in the inner peripheral portion (here, a portion ranging from a point B1 through a point B2 to a point B3) of a window frame 23 (here, a door frame) with which the closing-direction downstream side end portion (here, a portion ranging from a point Al through two points A2 and A3 to a point A4) of the window glass 3 can be contacted, in such a manner that the tube body 11 extends along the inner periphery of the window frame 23. By the way, in the present embodiment, the tube body 11 is disposed in the area ranging from the point B1 to the point B3 of the inner periphery portion of the window frame 23. However, when the weather strip 9 can also be disposed in the area ranging from the point B3 to the point B4, the tube body 11 may also be disposed in the area ranging from the point B3 to the point B4 as well.

Also, in order that a pressing force from a foreign object 35 (see FIG. 5) can be effectively given to the tube body 11 when the insertion of the foreign object 35 occurs, the tube body 11 is implanted into the weather strip 9 in such a manner that it is situated in such portion of the weather strip 9 that faces the inner peripheral portion 9*a* (here, the inner-most peripheral portion) of the weather strip 9.

Figure 4:
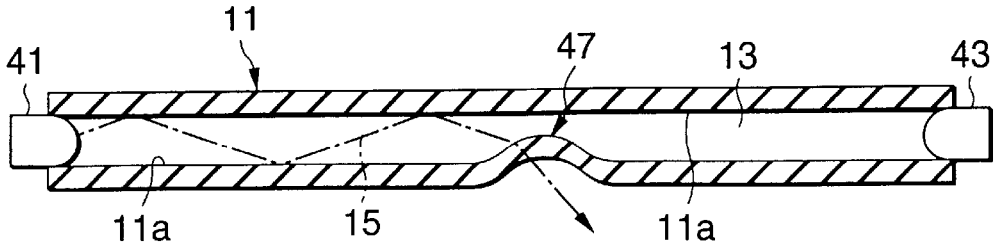
FIG. 4 is a section view of the tube body shown in FIG. 3, showing a state thereof when the insertion of a foreign object occurs.

Here, in order to be able to detect the insertion of the foreign object 35 with high sensitivity, preferably, as shown in FIG. 4, the tube body 11 may be elastically deformed with high sensitivity in such a manner that, as shown in FIG. 4, it is crushed in part.

Referring in more particular to this, on the closing-direction downstream (upstream) side of the windowpane 3 of the above implanted tube body 11, as shown in FIG. 2, there is situated the window frame 23; and, therefore, when a pressing force from the foreign object 35 is applied to the inner peripheral portion 9*a* of the weather strip 9 from a downward direction B parallel to the opening and closing direction A of the windowpane 3, the tube body 11 is elastically deformed with high sensitivity in such a manner that it is crushed between the window frame 23 and the inner peripheral end portion 9a of the weather strip 9, thereby being able to detect the insertion of the foreign object 35 with high sensitivity. However, when the pressing force from the foreign object 35 is applied to the inner peripheral portion 9*a* of the weather strip 9 from downward directions C and D extending obliquely with respect to the opening and closing direction A of the windowpane 3, the pressing force is dispersed, which makes it difficult for the tube body 11 to deform elastically.

In view of this, in the present embodiment, as will be discussed later in detail, the pressing means 12 are disposed on the two inner and outer sides of the inner peripheral end portion 9*a* of the weather strip 9, so that the pressing means 12 are able to cope properly with the pressing forces from the above-mentioned obliquely downward directions C and D.

By the way, normally, a sun visor is mounted on the windowpane 3 of the car. In this case, the foreign object 35 interferes with the sun visor and, therefore, the foreign object 35 is not contacted with the inner-most peripheral end (that is, the lower-most end) of the weather strip 9 but is contacted with such portion of the inner peripheral portion 9*a* that is located on the obliquely downward car exterior side thereof or on the obliquely downward car interior side thereof, so that the pressing force from the foreign object 35, as shown in FIG. 2, is applied to the inner peripheral portion 9*a* of the weather strip 9 from the obliquely downward directions C and D.

Now, the pressing means 12, as shown in FIG. 2, are disposed so that they detect the pressing forces of the foreign object 35 applied from the obliquely downward directions C and D with respect to the opening and closing direction A of the windowpane 3. And, referring to the structure of each of the pressing means 12, it comprises two cavity portions (first and second cavity portions) 31, 33 which are respectively formed on the obliquely downward car exterior side and car interior side of the weather strip 9 with respect to the tube body 11 along the longitudinal direction of the tube body 11, and two projecting portions (first and second projecting portions) 37, 39 which are provided respectively on the inner peripheral surfaces of the cavity portions 31, 33. The cavity portions 31 and 33 may be in communication with the outside or may be closed.

The two projecting portions 37 and 39 are provided respectively on the inner peripheral surfaces of the obliquely downward car exterior side and car interior side of their associated cavity portions 31 and 33 in such a manner that they project toward the tube body 11 and extend along the longitudinal directions of the cavity portions 31 and 33.

Figure 5:
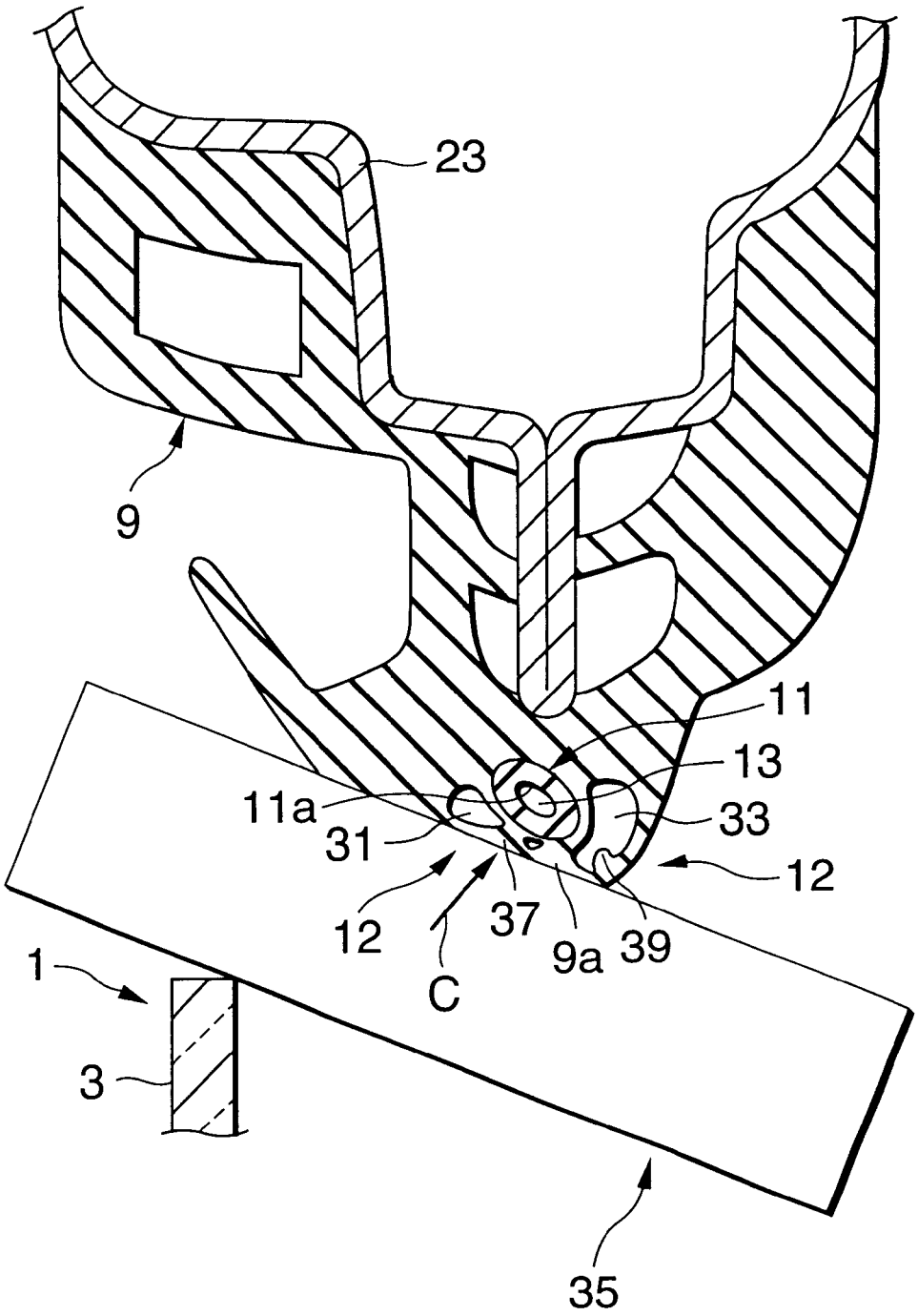
FIG. 5 is a section view of the weather strip shown in FIG. 2, showing a state thereof when the insertion of a foreign object occurs.

Thanks to this structure, as shown in FIG. 5, when the pressing forces of the foreign object 35 are applied to the inner peripheral portion 9*a* of the weather strip 9 from the obliquely downward directions C and D, the portions of the cavity portions 31 and 33 to which the pressing forces are applied are respectively pushed and crushed by the pressing forces, so that the projecting portions 37 and 39 provided on such cavity portions 31 and 33 are pressed against the tube body 11 and the portion of the weather strip 9 that encloses the tube portion 11.

As a result of this, the pressing forces from the foreign object 35 are given to the tube body 11 through the projecting portions 37 and 39 in such a manner that the pressing forces are not dispersed but are collected. Therefore, even when the pressing force from the foreign object 35 acts on the inner peripheral portion 9*a* of the weather strip 9 from the obliquely downward car exterior side and car interior side directions, as shown in FIGS. 4 and 5, the tube body 11 can be elastically deformed with high sensitivity in such a manner that it is crushed.

The thus structured tube body 11 and weather strip 9 are formed by a simultaneous extrusion molding.

The two end portions of the above-implanted tube body 11 in the longitudinal direction thereof are both opened. On one open end portion of the tube body 11, there is disposed a light emitting element (such as an infrared ray LED (light emitting diode) or the like) which is incorporated in the light emitting part 17; and, on the other open end portion thereof, there is disposed a light receiving element (such as a photo transistor or the like) which is incorporated in the light receiving part 19.

The light emitting element 41, as shown in FIG. 3, is structured such that it sends the light 15 from one side of the tube body 11 into the internal space 13. Since the light 15 sent into the internal space 13 enters the respective portions of the inner peripheral surface 11*a* of the tube body 11 at a sufficiently large angle of incidence when the tube body 11 is not yet deformed by the pressing force from the foreign object 35, the light 15 is transmitted through the internal space 13 with high efficiency while it is being reflected by the internal peripheral surface 11*a* of the tube body 11, and the light 15 is then received by the light receiving element 43 disposed on the other side of the tube body 11. Here, actually, until the light 15 travels through the internal space 13 and reaches the light receiving element 43, the light 15 is damped to a certain degree due to the leakage from the internal space 13, absorption by the internal space 13 or the like. However, by adjusting the light emitting intensity of the light emitting element 41 as well as the light receiving sensitivity of the light receiving element 43, the detection of the foreign object insertion can be achieved at a sufficiently high level.

On the other hand, while the windowpane 3 is being closed, as shown in FIGS. 4 and 5, if the insertion of the foreign object 35 occurs between the closing-direction downstream side end portion of the windowpane 3 and the inner peripheral portion of the window frame 23, then a pressing force from the foreign object 35 which is generated when the foreign object 35 is inserted is applied to the tube body 11 through the weather strip 9 and, due to the pressing force, the tube body 11 is elastically deformed in such a manner that the internal space 13 is in part crushed.

If the tube body 11 is elastically deformed in this manner, then the light 15 is shut out by the inner peripheral surface 11*a* of the deformed portion 47 of the tube body 11, which reduces the angle of incidence of the light 15 to thereby lower the reflection factor of the light 15. Due to the lowered reflection factor, part or the whole of the light 15 entering the inner peripheral surface 11*a* of the deformed portion 47 is not reflected by the inner peripheral surface 11*a* of the tube body 11 but is transmitted through the tube body 11 to leak externally out of the internal space 13, or is reflected in a direction where the light travels reversely through the internal space 13. As a result of this, the quantity of the light 15 entering the light receiving element 43 is decreased greatly.

Now, the light emitting part 17 includes the light emitting element 41 and a drive circuit (not shown) for driving the light emitting element 41, and the light emitting part 17 is structured such that it can emit the light 15 through the light emitting element 41 under the control of the judging part 21. On the other hand, the light receiving part 19 comprises the light receiving element 43 which receives the light 15 emitted by the light emitting element 41 and converts it to an electric signal corresponding to the quantity of the light received (that is, the intensity of the light received), an amplifier circuit (not shown) for amplifying the electric signal output by the light receiving element 43, and the like; and the light receiving part 19 outputs the thus amplified electric signals one by one to the judging part 21 sequentially.

In accordance with an instruction from the control part 7, the judging part 21, while allowing the light emitting element 41 of the light emitting part 17 to emit the light, monitors one by one the quantities of the light received by the light receiving element 43 through the electrical signals input from the light receiving part 19. And, if the quantity of the light received by the light receiving element 43 decreases by a given quantity or reaches or goes below a given reference value, then the judging part 21 judges that there exists the insertion of the foreign object, and thus gives the control part 7 an instruction to avoid the insertion of the foreign object. The decreased quantity or reference value of the received light quantity serving as the judging criterion depends on a pressing force applied to the tube body 11 by which the foreign object insertion is judged to be present. Also, such foreign object insertion judging operation by the judging part 21 is carried out by an instruction given by the control part 7.

The control part 7, in accordance with an input from an operation switch (not shown) which instructs the opening and closing of the windowpane 3, drives or controls the motor 5 to thereby control the opening and closing of the windowpane 3. And, when the windowpane 3 is to be closed, for example, the control part 7 controls the windowpane 3 to execute its closing operation while controlling the judging part 21 to execute its foreign body insertion detecting operation. When no insertion avoid instruction is given from the judging part 21, the control part 7 continues the closing operation of the windowpane 3 as it is to thereby close the windowpane 3 up to a given position (for example, a completely closed position). On the other hand, when an insertion avoid instruction is given from the judging part 21, the control part 7 causes the closing operation of the windowpane 3 to stop at once as well as allows the windowpane 3 to execute its opening operation up to its completely opened position.

Thanks to the above structure, in the present power window device, if there occurs the insertion of the foreign object 35 such as hand or the like while the window glass 3 is closed, then the tube body 11, as shown in FIGS. 4 and 5, is deformed in part due to the pressing force from the foreign object 35 produced due to the insertion of the foreign object 35, thereby causing the light 15 to leak at the deformed portion 47 of the tube body 11, so that the quantity of the light received by the light receiving element 43 decreases; the decrease in the quantity of the light 15 received is detected by the judging part 21 and the insertion of the foreign object 35 is thereby detected; the judging part 21 gives the control part 7 the instruction for avoiding the insertion of the foreign object 35; and, the control part 7 stops the closing operation of the windowpane 3 and allows the windowpane 3 to execute its opening operation, thereby being able to prevent the insertion of the foreign object.

As described above, according to the present embodiment, since the tube body 11 for detecting the foreign object insertion is disposed within the weather strip 9 which is provided in the inner peripheral portion of the window frame 23, it is possible to detect the insertion of the foreign object 35 just before the window glass 3 is completely closed.

Also, when the pressing forces from the foreign object 35 are given to the inner peripheral portion 9*a* of the weather strip 9 from the obliquely downward directions C and D, the pressing forces from the foreign object 35 are not dispersed but are collected together, that is, they are collectively given to the tube body 11 through the projecting portions 37 and 39. For this reason, not only when the pressing force from the foreign object 35 is given to the inner peripheral portion 9a of the weather strip 9 from a direction just below it, but also when the pressing force is given from the obliquely downward car-outside direction or from the obliquely downward car-inside direction, the tube body 11 can be elastically deformed in such a manner that it is crushed effectively, with the result that, even when the sun visor is mounted on the car window 1, the insertion of the foreign object can be detected positively.

Further, the internal space 13 of the tube body 11 is in communication with the outside of the tube body 11 and thus there is eliminated the need to seal the internal space 13. Thanks to this, when compared with the previously described second conventional foreign object insertion detect device, the structure of the tube body 11 can be simplified to a great extent, so that the present foreign object insertion detect device can be manufactured at a reduced cost.

Still further, the internal space 13 of the tube body 11 is filled with the air having a lower refractive index than that of the elastic material forming the tube body 11 and, unlike the second conventional foreign object insertion detect device in which the light is reflected totally, the light 15 is transmitted while it is being reflected by the inner peripheral surface 11*a* of the tube body 11. Due to this, when compared with the second conventional foreign object insertion detect device, the present foreign object insertion detect device is rather difficult to be influenced by the bending of the tube body 11. That is, the present foreign object insertion detect device is advantageous in that it can stand use under the condition where the tube body 11 is disposed in a bent shape.

And, differently from the second conventional foreign object insertion detect device, there is eliminated the need to charge the liquid or the like into the inside of the tube body 11, so that the hardness of the elastic material forming the tube body 11 can be set sufficiently low when compared with the second conventional foreign object insertion detect device. This can enhance greatly the sensitivity in detecting the pressing force from the foreign object 35. That is, when the foreign object 35 such as an operator's hand or the like is caught or inserted between the window frame and the windowpane, the insertion of the hand can be detected before the operator feels a pain in the hand. In particular, according to the present embodiment, it is possible to detect a pressing force of 10 N or less from the foreign object 35.

Also, since the internal space 13 of the tube body 11 is in communication with the outside of the tube body 11, even if the tube body 11 is elastically deformed due to the pressing force from the foreign object 35, the pressure within the internal space 13 is prevented from increasing but the tube body 11 can be deformed easily by a pressing force given from the outside. This makes it possible to detect the pressing force from the foreign object 35 with high sensitivity. That is, in this respect as well, the present embodiment is advantageous over the second conventional foreign object insertion detect device.

Further, since there is eliminated the need to enclose the liquid or the like into the internal space 13 of the tube body 11, there is no fear that the enclosed liquid or the like can leak out of the tube body 11, nor is there a possibility that the enclosed liquid such as water or the like can be frozen, or the tube body 11 can be caused to swell by the enclosed liquid and can be thereby made easy to deteriorate. That is, the present embodiment can provide an advantage that it can be used for a long period of time with high reliability.

Still further, because the tube body 11 is implanted into the weather strip 9, not only it is possible to prevent the foreign object 35 from coming into direct contact with the tube body 11 to thereby break the tube body 11, but also the tube body 11 can be protected from the external environments such as the wind, the rain, the sun and the like.

Yet further, since the tube body 11 and weather strip 9 are formed simultaneously by simultaneous extrusion molding, the manufacturing process of the present embodiment can be simplified to a great extent, thereby being able to reduce the manufacturing cost thereof.

In addition, because the infrared ray is used as the light 15 for detection, the light 15 can be transmitted while it is little absorbed by the tube body 11 and thus the quantity of the light emitted by the light emitting element 41 can be controlled to a minimum, which makes it possible to detect the insertion of the foreign object with high efficiency.

By the way, in the present embodiment, description has been given of a sedan in which the weather strip 9 for waterproofing the car window 1 is disposed in the window frame (door frame) 23. However, the present embodiment can also apply similarly to a hardtop in which the weather strip 9 is disposed in the window frame 23 that is located on the vehicle body side.

Also, in the present embodiment, the infrared ray is used as the light 15 for detection. However, this is not limitative but it is also possible to use other kinds of rays, for example, a visible ray or the like.

2. Second Embodiment

Figure 6:
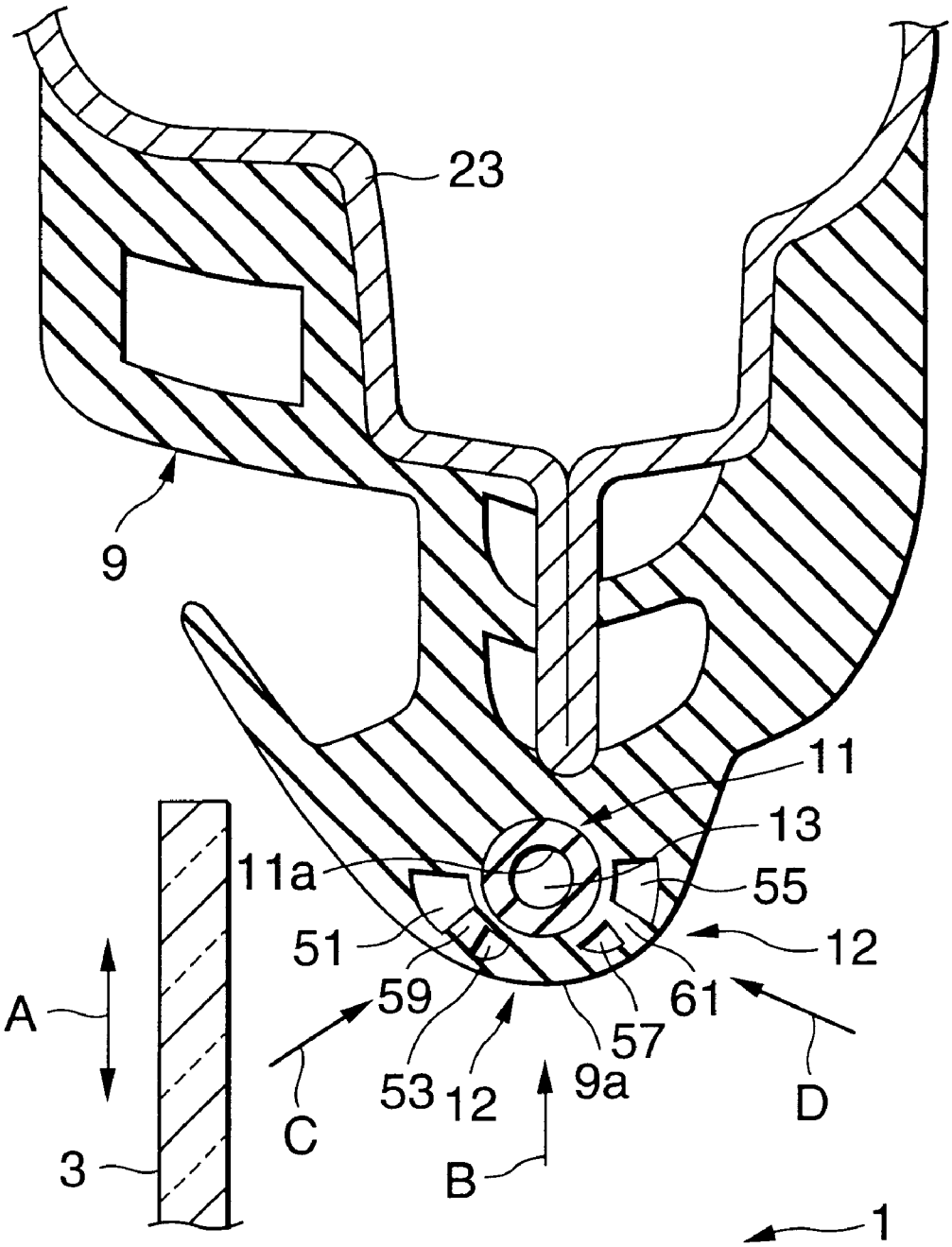
FIG. 6 is a section view of a weather strip employed in a car power window device to which a foreign object insertion detector device according to a second embodiment of the invention is applied.

Now, FIG. 6 is a section view of a weather strip incorporated in a car power window device to which a foreign object insertion detect device according to a second embodiment of the invention is applied. The power window device according to the second embodiment is different from the power window device according to the first embodiment only in the structure of the pressing means to be used in the weather strip 9, and thus the power window device according to the second embodiment is similar in the remaining portions thereof to the power window device according to the first embodiment. Therefore, in the second embodiment, the parts thereof that correspond to those employed in the first embodiment are given the same designations and thus the description thereof is omitted here.

In the present embodiment, the pressing means 12, as shown in FIG. 6, comprises two pairs of cavity portions (that is, the third to sixth cavity portions) 51, 53 and 55, 57 which are respectively formed in the weather strip 9, in more particular, on the obliquely downward car exterior side and car interior side thereof with respect to the tube body 11 in such a manner that they are spaced from each other by a given distance substantially in the vertical direction; and, two pressing portions 59 and 61 formed in the weather strip 9, in more particular, in the portions thereof which are situated between the cavity portions 51 and 53 as well as between the cavity portions 55 and 57. And, the cavity portions 51, 53, 55 and 57 are respectively disposed along the longitudinal direction of the tube body 11, while they may be so formed as to communicate with the outside or may be closed to the outside.

Here, the two left and right pairs of cavity portions 51, 53, and 55, 57 are formed in such a manner that the two pressing portions 59 and 61 can be situated on the obliquely downward car exterior side and car interior side of the weather strip 9 with respect to the tube body 11.

Figure 7:
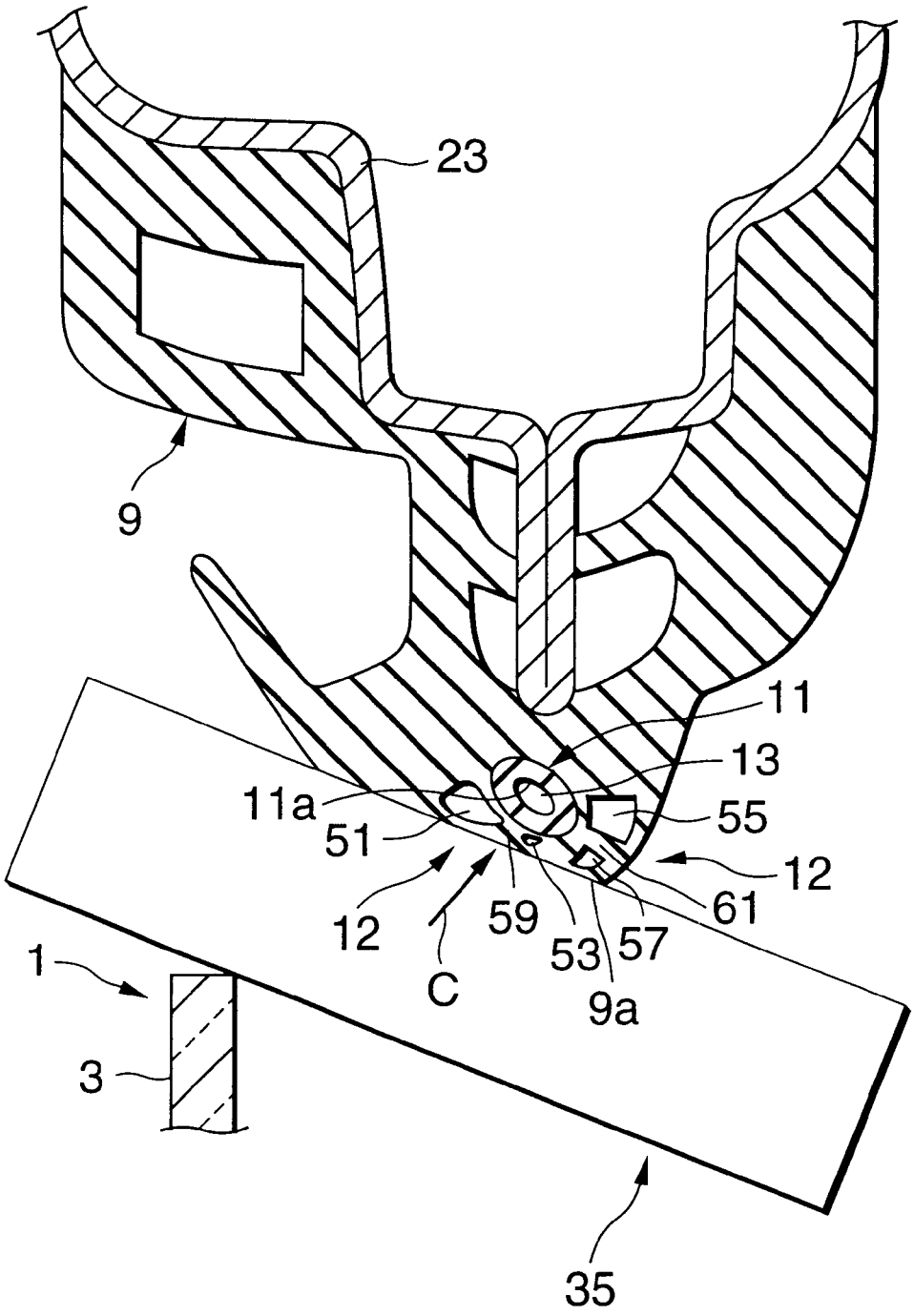
FIG. 7 is a section view of the weather strip shown in FIG. 6, showing a state thereof when the insertion of a foreign object occurs.

Thanks to the above structure, as shown in FIG. 7, when pressing forces from the foreign object 35 are applied to the inner peripheral portion 9*a* of the weather strip 9 from obliquely downward directions C and D, the portions of the two pairs of cavity portions 51, 53 and 55, 57 on which the pressing forces act are respectively crushed by the pressing forces, so that the two pressing portions 59 and 61 respectively interposed between the two pairs of cavity portions 51, 53 and 55, 57 are pushed against the tube body 11 and the portions of the weather strip 9 that enclose the tube body 11.

As a result of this, the pressing forces from the foreign object 35, as they are, are given to the tube body 11 through the two pressing portions 59 and 61 in such a manner that they are not dispersed but are collected together. Thanks to this, even if the pressing forces from the foreign object 35 are applied to the inner peripheral portion 9*a* of the weather strip 9 from the obliquely downward car exterior side and obliquely downward car interior side directions, as shown in FIG. 7, the tube body 11 can be elastically deformed with high sensitivity in such a manner that it is crushed.

As can be clearly understood from the above description, according to the present embodiment as well, there can be obtained similar effects to those obtained in the previously described first embodiment.

3. Third Embodiment

Figure 8:
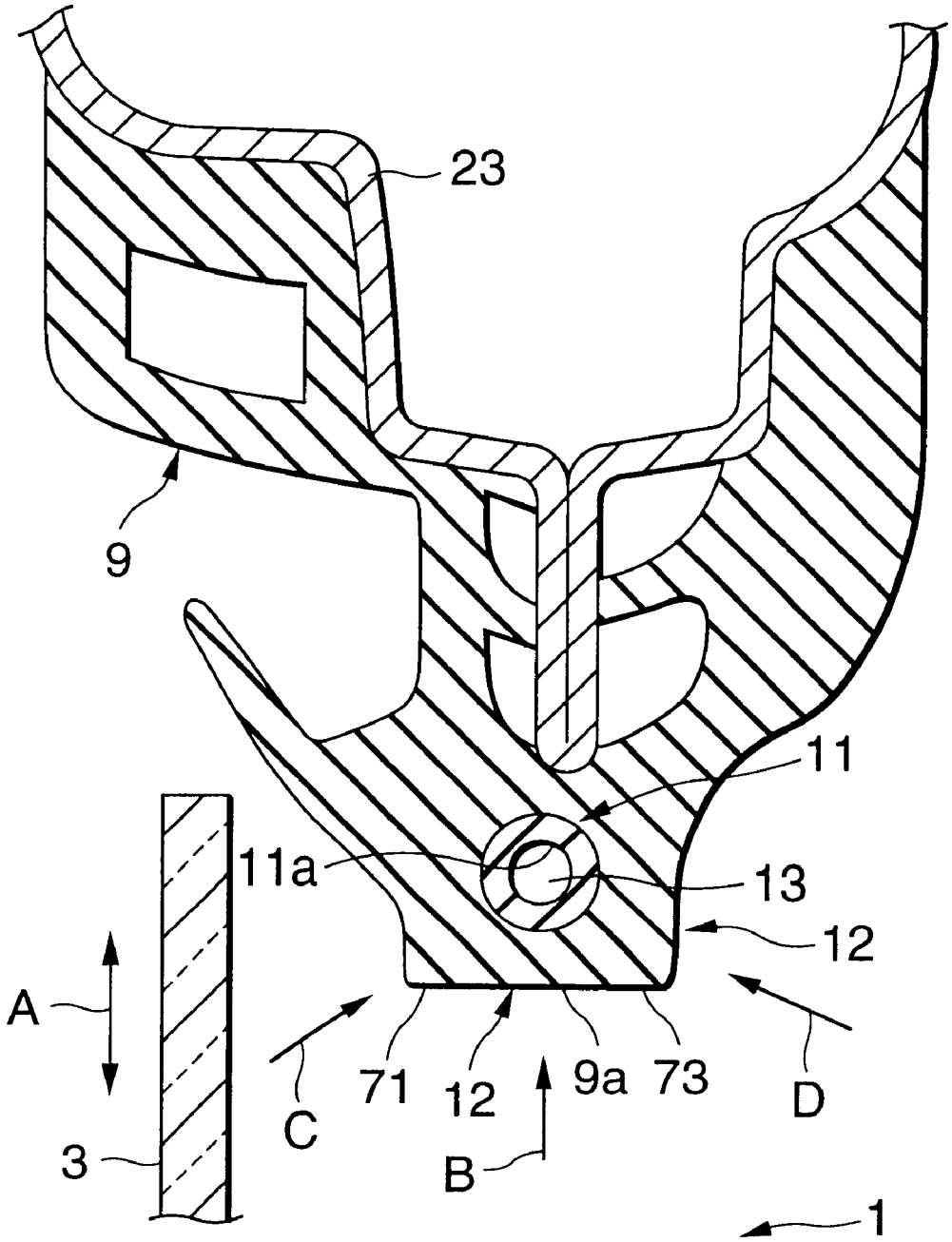
FIG. 8 is a section view of a weather strip employed in a car power window device to which a foreign object insertion detector device according to a third embodiment of the invention is applied.

Now, FIG. 8 is a section view of a weather strip incorporated in a car power window device to which a foreign object insertion detect device according to a third embodiment of the invention is applied. The power window device according to the third embodiment is different from the power window device according to the first embodiment only in the structure of the pressing means to be used in the weather strip 9, and thus the power window device according to the third embodiment is similar in the remaining portions thereof to the power window device according to the first embodiment. Therefore, in the third embodiment, the parts thereof that correspond to those employed in the first embodiment are given the same designations and thus the description thereof is omitted here.

In the present embodiment, as shown in FIG. 8, the pressing means 12 is composed of two corner portions 71 and 73 which are respectively formed integrally with the weather strip 9 and located on the obliquely downward car exterior side and car interior side of the weather strip 9 with respect to the tube body 11 in such a manner that their respective sections project in a right-angle manner.

By the way, generally, the inner peripheral portion of the conventional weather strip 9 has an arc-shaped section. However, in the case of such arc-shaped inner peripheral portion, when the foreign object 35 comes into contact with the inner peripheral portion from the obliquely downward car exterior side direction or obliquely downward car interior side direction, the foreign object 35 and the inner peripheral portion 9*a* of the weather strip 9 are difficult to get into contact with each other. This raises a fear that the detection of the foreign object 35 insertion by the tube body 11 can be delayed. At the same time, since the contact area of the contact portions between the foreign object 35 and the inner peripheral portion 9*a* of the weather strip 9 becomes large, the pressing force from the foreign object 35 is dispersed, with the result that the tube body 11 cannot be elastically deformed in an effective manner.

In view of the above, in the present embodiment, the section shape of the inner peripheral portion 9*a* of the weather strip 9 is formed in a U shape so that it can be angular on the car exterior side and car interior side thereof, whereby the foreign object 35 is easy to come into contact with the inner peripheral portion 9*a* of the weather strip 9 as well as the foreign object 35 can get contact with the inner peripheral portion 9*a* of the weather strip 9 in a small contact area.

Figure 9:
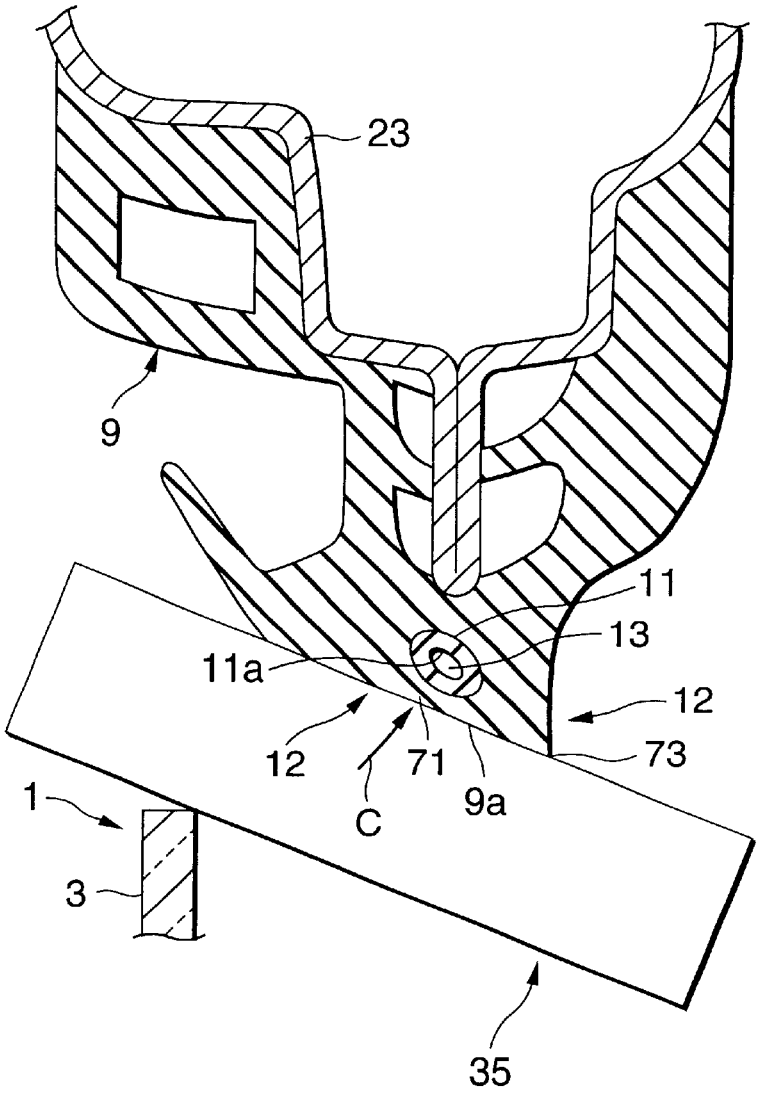
FIG. 9 is a section view of the weather strip shown in FIG. 8, showing a state thereof when the insertion of a foreign object occurs.

Thanks to this structure, as shown in FIG. 9, when the insertion of the foreign object 35 occurs in a car with a sun visor mounted thereon and the foreign object 35 is contacted with the weather strip 9 from obliquely downward directions C and D, either of the inside or outside corner portion 71 or 73 is able to come into contact with the foreign object 35 positively, accurately and in a small contact area, with the result that the pressing force from the foreign object 35 can be applied to the tube body 11 through the corner portions 71 and 73 of the weather strip 9 in such a manner that it is not dispersed but is collected. Therefore, the tube body 11 can be elastically deformed with high sensitivity in such a manner that it is crushed.

As can be clearly understood from the above description, in the present embodiment as well, there can be obtained similar effects to those obtained in the previously described first embodiment.

4. Modifications

Now, description will be given below of modifications according to the above-mentioned first to third embodiments of the invention.

Figure 10:
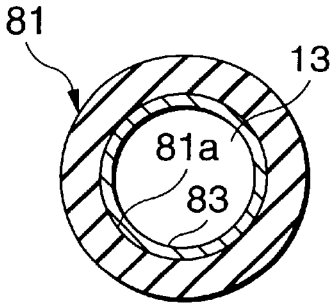
FIG. 10 is a section view of a first modification of the tube body according to the first to third embodiments of the invention.

FIG. 10 is a section view of a tube body 81 which is a first modification of the tube body 11 according to the previously described first to third embodiments of the invention. This tube body 81 is similar to the above-mentioned tube body 11 except that the inner peripheral surface 81*a* thereof is coated with a light reflecting member 83.

The light reflecting member 83, at least in the wavelength area of the light 15, is formed of a material having a high reflection factor; and, as the material having a high reflection factor, for example, there is used metal such as silver, rhodium and chrome, or ceramics such as alumina, silica or the like.

According to the present modification, since the inner peripheral surface 81*a* of the tube body 81 is coated with the light reflecting member 83, the light reflecting factor of the inner peripheral surface 81*a* of the tube body 81 can be enhanced. Thanks to this, while controlling the quantity of the light emitted by the light emitting element 81 down to a minimum, the detection of the foreign object insertion can be achieved with high efficiency.

Figure 11:
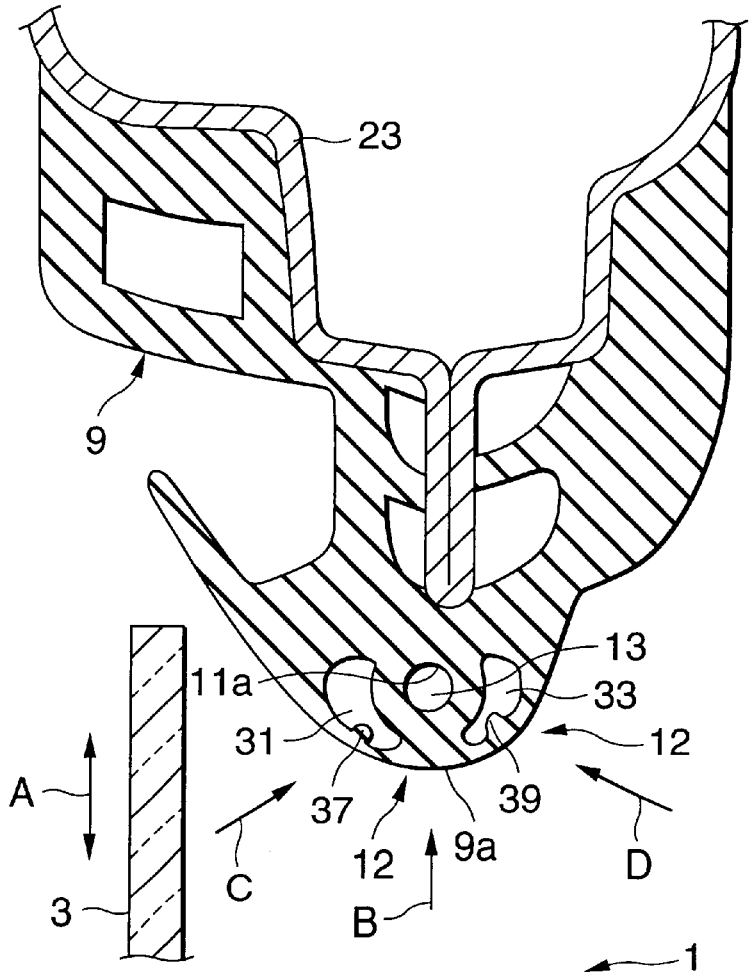
FIG. 11 is a section view of a weather strip, showing a modification of a method for forming an internal space (a light transmitting cavity portion) serving as a light transmission path according to the first to third embodiments of the invention.

Next, FIG. 11 is a section view of a modification relating to a method for forming the internal space (light transmitting cavity portion) 13 which is a transmission path for the light 15. In the present modification, the tube body 11 is omitted and, instead of this, a cavity portion formed in the weather strip 9 is used directly as the light transmitting cavity portion 13. FIG. 11 shows a case in which the present modification is applied to the weather strip 9 according to the first embodiment of the invention.

According to the present modification, since the tube body 11 is omitted, the structure of the present modification is simplified by an amount corresponding to the omission of the tube body 11, which makes it possible to simplify the manufacturing process thereof.

Figure 12:
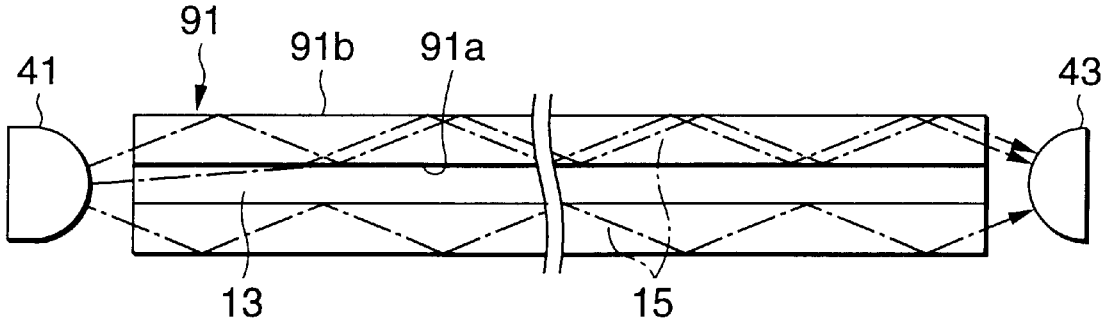
FIG. 12 is a typical section view of the structure of a second modification of a tube body according to the first to third embodiments of the invention; and, FIG. 13 is a section view of the tube body shown in FIG. 12, showing a state thereof when the insertion of a foreign object occurs.

Now, FIG. 12 is a section view of a typical structure of a tube body 91 which is a second modification of the tube body 11 according to the first to third embodiments of the invention.

In the present modification, the tube body 91 is formed of an elastic material which allows the light to transmit therethrough and, therefore, as shown in FIG. 12, the tube body 91 is structured such that the light 15 can be transmitted through the tube body 91 in the longitudinal direction thereof. As the elastic material for forming the tube body 91, there can be used a similar elastic material to the tube body 11 according to the first embodiment, provided that it has a good light transmission property.

Also, preferably, as the elastic material for forming the tube body 91, there may be selected a material having a higher refractive index than that of the gas (here, the air) for filling the internal space 13 full and that of the elastic material for forming the weather strip 9. Due to this, when the light 15 is transmitted through the tube body 91, if the light 15 enters the inner peripheral surface 91*a* and outer peripheral surface 91*b* of the tube body 91 at a given angle of incidence (a critical angle) or larger, then the light 15 is reflected totally. As a result of this, the reflection factor of the light 15 on the inner peripheral surface 91*a* and outer peripheral surface 91*b* of the tube body 91 can be enhanced, thereby being able to transmit the light 15 with high efficiency.

According to the thus structured tube body 91, in a state where the pressing force from the foreign object 35 is not applied to the tube body 91, as shown in FIG. 12, the light 15 emitted from the light emitting element 41 enters the tube body 91 from the end face of one side end portion of the tube body 91 and the inner peripheral surface 91*a* of the tube body 91, is transmitted through the tube body 91 while being reflected by the inner peripheral surface 91*a* and outer peripheral surface 91*b* of the tube body 91, is discharged from the other side end portion of the tube body 91, and is then received by the light receiving element 43.

Figure 13:
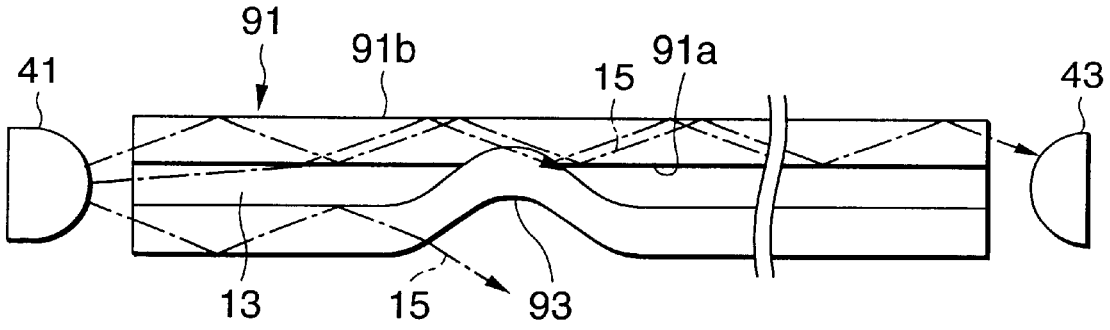

On the other hand, when the pressing force from the foreign object 35 is applied to the tube body 91 due to the insertion of the foreign object and the tube body 91 is thereby elastically deformed in such a manner as shown in FIG. 13, the angle of incidence of the light 15 entering the inner peripheral surface 91*a* and outer peripheral surface 91*b* of the elastically deformed portion 93 of the tube body 91 decreases, so that the whole or part of the light 15 passing through the tube body 91 leaks to the outside from within the tube body 91, thereby reducing the quantity of the light received by the light receiving element 43 to a great extent.

Therefore, in the present modification as well, similarly to the first to third embodiments, by detecting the decrease in the quantity of the light received by the light receiving element 43 in the judging part 21, the occurrence of the foreign object insertion can be detected.

As described above, according to the present modification, due to the fact that, as the elastic material for forming the tube body 91, there is used the material having a higher refractive index than that of the air within the internal space 13 and that of the elastic material for forming the weather strip 9, the reflection factor of the light 15 on the inner peripheral surface 91*a* and outer peripheral surface 91*b* of the tube body 91 can be enhanced, thereby being able to transmit the light 15 with high efficiency. As a result of this, the occurrence of the foreign object insertion can be detected with high efficiency while controlling the quantity of the light emitted by the light emitting element 41 down to a minimum.

By the way, in the present modification, the occurrence of the foreign object insertion is detected in accordance with the variations in the quantity of the light 15 being transmitted through the tube body 91 itself. However, this is not limitative but, alternatively, the light 15 emitted by the light emitting element 41 may be transmitted through the tube body 91 as well as through the internal space 13 of the tube body 91, and the thus transmitted light 15 may be received by the light receiving element 43, whereby the occurrence of the foreign object insertion can be detected in accordance with variations (decreases) in the quantity of the light 15 being transmitted through the tube body 91 as well as through the internal space 13 of the tube body 91, while such variations in the light quantity are caused when the tube body 91 is elastically deformed due to the pressing force from the foreign object 35.

Also, in the above-mentioned respective embodiments, the pressing means 12 are disposed on the two inner and outer sides of the inner peripheral portion 9*a* of the weather strip 9. However, this is not limitative but the pressing means 12 may be disposed only on one side of the inner peripheral portion 9*a* of the weather strip 9.

According to the first aspect of the present invention, the light transmitting cavity portion is so formed in the inner peripheral portion of the weather strip as to extend along the longitudinal direction of the inner peripheral portion of the weather strip, and a decrease in the quantity of the light, which is transmitted through the light transmitting cavity portion, caused when the light transmitting cavity portion is deformed in a crushing manner by the pressing force from the foreign object is detected to thereby detect the insertion of the foreign object. Thanks to this, the insertion of the foreign object can be detected just before the windowpane is closed completely.

Also, on at least one of the obliquely downward car exterior side or obliquely downward car exterior side of the light transmitting cavity portion in the weather strip, there is formed the pressing means which receives the pressing force from an obliquely downward direction with respect to the opening and closing direction of the windowpane to thereby deform the light transmitting cavity portion in such a manner that it is crushed. Thanks to this, not only when the pressing force from the foreign object is applied to the inner peripheral portion of the weather strip just from below, but also when such pressing force is applied from the obliquely downward car exterior side or obliquely downward car exterior side, the light transmitting cavity portion can be deformed in such a manner that it can be crushed effectively. As a result of this, even when the sun visor is mounted on the car window, the insertion of the foreign object can be detected positively.

Further, since the light transmitting cavity portion is in communication with the outside and need not be closed, when compared with the second conventional foreign object insertion detector device which requires enclosing the transparent liquid, the structure of the tube body can be simplified to a great extent, which makes it possible to manufacture the present foreign object insertion detector device at a low cost.

And, because it is not necessary to enclose the liquid or the like into the light transmitting cavity portion as in the second conventional foreign object insertion detector device, when compared with second conventional foreign object insertion detector device, the hardness of the elastic material forming the light transmitting cavity portion (in particular, when the light transmitting cavity portion is formed by implanting a given tube body into the weather strip, the material of the tube; or, when the light transmitting cavity portion is formed in the weather strip itself, the material of the weather strip) can be set sufficiently low. This can enhance greatly the detecting sensitivity of the pressing force applied from the foreign object and, therefore, when an operator's hand or the like is inserted between the window frame and the windowpane, the insertion thereof can be detected before the operator feels a pain in the hand.

Also, since the light transmitting cavity portion is so formed as to communicate with the outside, even if the light transmitting cavity portion is deformed in a crushing manner by the pressing force from the foreign object, the internal pressure thereof does not increase at all and thus the light transmitting cavity portion can be deformed easily by a pressing force given from the outside. Therefore, the pressing force from the foreign object can be detected with high sensitivity. That is, the present invention is advantageous in this respect as well over the second conventional foreign object insertion detector device.

Further, because there is eliminated the need to enclose the liquid or the like into the light transmitting cavity portion, there is no fear that the enclosed liquid or the like can leak out to the outside, nor a fear that the enclosed water or the like can be frozen or the portion of the weather strip surrounding the light transmitting cavity portion can be caused to swell and thus deteriorate due to the enclosed liquid. Therefore, the invention is advantageous in that it can be used for a long period of time with high reliability.

According to the second aspect of the present invention, when the pressing force from the foreign object is given to the inner peripheral portion of the weather strip from the obliquely downward car exterior side, the first cavity portion is crushed by the pressing force and the first projecting portion of the first cavity portion is pressed against the portion of the weather strip surrounding the light transmitting cavity portion, with the result that the pressing force is given through the first projecting portion to the portion of the weather strip surrounding the light transmitting cavity portion collectively without being dispersed. That is, even when the pressing force from the foreign object is given to the inner peripheral portion of the weather strip from the obliquely downward car exterior side, the light transmitting cavity portion can be deformed in such a manner that it is crushed effectively.

According to the third aspect of the present invention, when the pressing force from the foreign object is given to the inner peripheral portion of the weather strip from the obliquely downward car interior side, the second cavity portion is crushed by the pressing force and the second projecting portion of the second cavity portion is pressed against the portion of the weather strip surrounding the light transmitting cavity portion, with the result that the pressing force is given through the second projecting portion to the portion of the weather strip surrounding the light transmitting cavity portion collectively without being dispersed. That is, even when the pressing force from the foreign object is given to the inner peripheral portion of the weather strip from the obliquely downward car interior side, the light transmitting cavity portion can be deformed in such a manner that it is crushed effectively.

According to the fourth aspect of the present invention, when the pressing force from the foreign object is given to the inner peripheral portion of the weather strip from the obliquely downward car exterior side, the third and fourth cavity portions are respectively crushed by the pressing force and the portion the weather strip situated between the third and fourth cavity portions, as a pressing portion, is pressed against the portion of the weather strip surrounding the light transmitting cavity portion, with the result that the pressing force is given through the pressing portion to the portion of the weather strip surrounding the light transmitting cavity portion collectively without being dispersed. That is, even when the pressing force from the foreign object is given to the inner peripheral portion of the weather strip from the obliquely downward car exterior side, the light transmitting cavity portion can be deformed in such a manner that it is crushed effectively.

According to the fifth aspect of the present invention, when the pressing force from the foreign object is given to the inner peripheral portion of the weather strip from the obliquely downward car interior side, the fifth and sixth cavity portions are respectively crushed by the pressing force and the portion the weather strip situated between the fifth and sixth cavity portions, as a pressing portion, is pressed against the portion of the weather strip surrounding the light transmitting cavity portion, with the result that the pressing force is given through the pressing portion to the portion of the weather strip surrounding the light transmitting cavity portion collectively without being dispersed. That is, even when the pressing force from the foreign object is given to the inner peripheral portion of the weather strip from the obliquely downward car interior side, the light transmitting cavity portion can be deformed in such a manner that it is crushed effectively.

According to the sixth aspect of the present invention, when there occurs the insertion of the foreign object in a car with a sun visor mounted thereon and the foreign object is contacted with the inner periphery of the weather strip from the obliquely downward car exterior side or obliquely downward car exterior side, the obliquely downward car exterior side or obliquely downward car interior side corner portion of the inner peripheral portion of the weather strip can be contacted with the foreign object in a small contact area positively and accurately, with the result that the pressing force from the foreign object can be given through such corner portion to the portion of the weather strip surrounding the light transmitting cavity portion collectively without being dispersed. Therefore, even when the pressing force from the foreign object is given to the inner peripheral portion of the weather strip from the obliquely downward car exterior side or obliquely downward car interior side, the light transmitting cavity portion can be deformed in such a manner that it is crushed effectively.

According to the seventh aspect of the present invention, since the inner peripheral surface of the light transmitting cavity portion is coated with a light reflecting member, the light reflection factor of the inner peripheral surface of the light transmitting cavity portion can be enhanced, which makes it possible to detect the insertion of the foreign object with high efficiency while controlling the quantity of the light of the light emitting means to a minimum.

According to the eighth aspect of the present invention, because it is not necessary to implant a tube body into the weather strip, the present foreign object insertion detector device can be simplified in structure by an amount corresponding to the omission of the tube body, which in turn can simplify the manufacturing process of the present foreign object insertion detector device.

According to the ninth aspect of the present invention, in at least one of the obliquely downward car exterior side and obliquely downward car exterior side of the tube body in the weather strip, there is disposed the pressing means which receives the pressing force given from the obliquely downward direction with respect to the opening and closing direction of the windowpane to thereby deform the tube body elastically in such a manner that the tube body is crushed. Thanks to this, not only when the pressing force from the foreign object is applied to the inner peripheral portion of the weather strip just from below, but also when such pressing force is applied from the obliquely downward car exterior side or obliquely downward car interior side, the tube body can be deformed in such a manner that it can be crushed effectively. As a result of this, even when the sun visor is mounted on the car window, the insertion of the foreign object can be detected positively. That is, there can be obtained similar effects to the first aspect of the present invention.

What is claimed is:

1. A foreign object insertion detector device for detecting the insertion of a foreign object between a car window frame and a windowpane when the car window is closed by the windowpane, said foreign object insertion detector device comprising:

a weather strip disposed in said car window frame and including, in an inner peripheral portion of the weather strip opposed to a closing-direction downstream edge of said windowpane, a light transmitting cavity portion extending in the longitudinal direction of said inner peripheral portion and communicating with the outside;

pressing means which is disposed at least on one of an obliquely downward car exterior side and obliquely downward car interior side of said light transmitting cavity portion of said weather strip, and which, on receiving a pressing force, resulting from a force of a closing windowpane on the inserted foreign object, that is transmitted in an obliquely downward direction with respect to the opening and closing direction of said windowpane through said weather strip to deform said light transmitting cavity portion by concentrating the pressing force toward the light transmitting cavity portion;

light emitting means for emitting a given light into said light transmitting cavity portion from one end of said light transmitting cavity portion;

light receiving means for receiving said light emitted by said light emitting means, reflected by an inner peripheral surface of said light transmitting cavity portion and transmitted to the other end of said light transmitting cavity portion; and judging means for monitoring the quantity of the light received by said light receiving means, and for judging the presence of the insertion of said foreign object on detecting a decrease in the quantity of said received light caused when said weather strip is elastically deformed by said pressing force and said light transmitting cavity portion is deformed, wherein the pressing means comprises a cavity formed on at least one of the obliquely downward car interior side or exterior side of said light transmitting cavity portion in said weather strip in such a manner that it extends in the longitudinal direction of said light transmitting cavity portion and a projection provided on the at least one obliquely downward car interior side or exterior side inner peripheral surface of said cavity in such a manner that it extends in the longitudinal direction of said cavity, said projection being capable of deforming said light transmitting cavity.

2. A foreign object insertion detector device as claimed in claim 1, wherein the inner peripheral surface of said light transmitting cavity portion is coated with a given light reflecting member for reflecting said light.

3. A foreign object insertion detector device as claimed in claim 1, wherein said light transmitting cavity portion is formed by implanting a hollow tube body formed of an elastic material into said weather strip.

4. A foreign object insertion detector device as claimed in claim 1, wherein said light transmitting cavity portion is formed by forming a cavity in said weather strip itself.

5. A foreign object insertion detector device for detecting the insertion of a foreign object between a car window frame and a windowpane when the car window is closed by the windowpane, said foreign object insertion detector device comprising:

a weather strip disposed in said car window frame and including, in an inner peripheral portion of the weather strip opposed to a closing-direction downstream edge of said windowpane, a light transmitting cavity portion extending in the longitudinal direction of said inner peripheral portion and communicating with the outside;

pressing means which is disposed at least on one of an obliquely downward car exterior side and obliquely downward car interior side of said light transmitting cavity portion of said weather strip, and which, on receiving a pressing force, resulting from a force of a closing windowpane on the inserted foreign object, that is transmitted in an obliquely downward direction with respect to the opening and closing direction of said windowpane through said weather strip to deform said light transmitting cavity portion by concentrating the pressing force toward the light transmitting cavity portion;

light emitting means for emitting a given light into said light transmitting cavity portion from one end of said light transmitting cavity portion;

light receiving means for receiving said light emitted by said light emitting means, reflected by an inner peripheral surface of said light transmitting cavity portion and transmitted to the other end of said light transmitting cavity portion; and judging means for monitoring the quantity of the light received by said light receiving means, and for judging the presence of the insertion of said foreign object on detecting a decrease in the quantity of said received light caused when said weather strip is elastically deformed by said pressing force and said light transmitting cavity portion is deformed, wherein said pressing means comprises first and second cavities both formed on at least one of the obliquely downward car interior side or exterior side of said light transmitting cavity portion in said weather strip in such a manner that they extend in the longitudinal direction of said light transmitting cavity portion and are spaced from each other by a given distance substantially in the vertical direction and a portion of said weather strip situated between said first and second cavities acting as a pressing portion for deforming said light transmitting cavity portion.

6. A foreign object insertion detector device as claimed in claim 5, wherein the inner peripheral surface of said light transmitting cavity portion is coated with a given light reflecting member for reflecting said light.

7. A foreign object insertion detector device as claimed in claim 5, wherein said light transmitting cavity portion is formed by implanting a hollow tube body formed of an elastic material into said weather strip.

8. A foreign object insertion detector device as claimed in claim 5, wherein said light transmitting cavity portion is formed by forming a cavity in said weather strip itself.

9. A foreign object insertion detector device for detecting the insertion of a foreign object between a car window and a windowpane when the car window is closed by the windowpane, said foreign object insertion detector device comprising:

a hollow tube body formed of light transmissive elastic material and implanted in a portion of an inner peripheral portion of a weather strip disposed in said car window, which is situated opposed to a closing-direction downstream edge of said windowpane, in such a manner that it extends in the longitudinal direction of said inner peripheral portion of said weather strip, an internal space of said tube body communicating with the outside;

pressing means disposed at least on one of an obliquely downward car exterior side and obliquely downward car interior side of said inner peripheral portion of said weather strip and, on receiving a pressing force, resulting from a force of a closing windowpane on the inserted foreign object, that is transmitted in an obliquely downward direction with respect to the opening and closing direction of said windowpane through said inner peripheral portion of said weather strip to deform said tube body by concentrating the pressing force toward the light transmitting cavity portion;

light emitting means for emitting a light into at least one of said internal space and said tube body from one end of said tube body;

light receiving means for receiving said light emitted by said light emitting means, transmitted through at least one of said internal space and said tube body, and transmitted to the other end of said tube body; and, judging means for monitoring the quantity of the light received by said light receiving means, and also for judging the presence of the insertion of said foreign object on detecting a decrease in the quantity of said received light caused when said weather strip is elastically deformed by said pressing force and said tube body is thereby deformed, wherein the pressing means comprises a cavity formed on at least one of the obliquely downward car interior side or exterior side of said light transmitting cavity portion in said weather strip in such a manner that it extends in the longitudinal direction of said light transmitting cavity portion and a projection provided on the at least one obliquely downward car interior side or exterior side inner peripheral surface of said cavity in such a manner that it extends in the longitudinal direction of said cavity, said projection being capable of deforming said light transmitting cavity.

10. A foreign object insertion detector device as claimed in claim 9, wherein said light emitting means emits said light into said tube body from said one end of said tube body; and said light receiving means receives said light emitted by said light emitting means, transmitted through said tube body, and transmitted to the other end of said tube body.

11. A foreign object insertion detector device for detecting the insertion of a foreign object between a car window and a windowpane when the car window is closed by the windowpane, said foreign object insertion detector device comprising:

a hollow tube body formed of light transmissive elastic material and implanted in a portion of an inner peripheral portion of a weather strip disposed in said car window, which is situated opposed to a closing-direction downstream edge of said windowpane, in such a manner that it extends in the longitudinal direction of said inner peripheral portion of said weather strip, an internal space of said tube body communicating with the outside;

pressing means disposed at least on one of an obliquely downward car exterior side and obliquely downward car interior side of said inner peripheral portion of said weather strip and, on receiving a pressing force, resulting from a force of a closing windowpane on the inserted foreign object, that is transmitted in an obliquely downward direction with respect to the opening and closing direction of said windowpane through said inner peripheral portion of said weather strip to deform said tube body by concentrating the pressing force toward the light transmitting cavity portion;

light emitting means for emitting a light into at least one of said internal space and said tube body from one end of said tube body;

light receiving means for receiving said light emitted by said light emitting means, transmitted through at least one of said internal space and said tube body, and transmitted to the other end of said tube body; and, judging means for monitoring the quantity of the light received by said light receiving means, and also for judging the presence of the insertion of said foreign object on detecting a decrease in the quantity of said received light caused when said weather strip is elastically deformed by said pressing force and said tube body is thereby deformed, wherein the pressing means comprises first and second cavities both formed on at least one of the obliquely downward car interior side or exterior side of said light transmitting cavity portion in said weather strip in such a manner that they extend in the longitudinal direction of said light transmitting cavity portion and are spaced from each other by a given distance substantially in the vertical direction and a portion of said weather strip situated between said first and second cavities acting as a pressing portion for deforming said light transmitting cavity portion.

* * * * *